United States Patent [19]

Lubov

[11] 3,965,845

[45] June 29, 1976

[54] BOAT PROPELLER PROTECTIVE STRUCTURE

[76] Inventor: Michael T. Lubov, 8 Broadway, Lawrence, N.Y. 11559

[22] Filed: Nov. 26, 1975

[21] Appl. No.: 635,625

[52] U.S. Cl. ..... 115/42
[51] Int. Cl.[2] ..... B63H 5/16
[58] Field of Search ..... 115/42, 40

[56] References Cited

UNITED STATES PATENTS

| | | | |
|---|---|---|---|
| 1,028,333 | 6/1912 | Desenberg et al. | 115/42 |
| 2,717,570 | 9/1955 | Willoughby | 115/42 |
| 2,985,133 | 5/1961 | Shaffer | 115/42 |
| 3,099,240 | 7/1963 | Montague, Jr. | 115/42 |

*Primary Examiner*—Duane A. Reger
*Assistant Examiner*—Stuart M. Goldstein
*Attorney, Agent, or Firm*—Bauer, Amer & King

[57] ABSTRACT

A structure mounted in surrounding relation about a boat propeller and thereby in an advantageous position to minimize contact with, and thus possible damage to, the propeller by any debris in the path of the boat.

6 Claims, 7 Drawing Figures

BOAT PROPELLER PROTECTIVE STRUCTURE

The present invention relates to improvements for a propeller-powered boat, and more particularly to a simple structure readily mountable in depending relation from the bottom of the boat in protecting relation about the propeller to thereby minimize damaging contact with the propeller by debris or the like.

An important contribution of the present invention is the recognition that damage to the boat propeller caused by contact with debris or the like can, and should, be prevented by a suitable debris-blocking structure, and that said structure, despite its position surrounding the propeller, can withstand the pressure and forces imposed on it by powering operation of the propeller, without being unduly complex, and that such positioned structure does not adversely affect the operation, i.e. steering, etc., of the boat. There is no known effective propeller-protecting structure, due undoubtedly to the inability heretofore to provide debris-blocking structure near enough to the propeller to achieve this function, and yet capable of withstanding the forces generated by the propeller.

Broadly, it is an object of the present invention to provide a propeller-surrounding protective structure effective to block debris from contacting the propeller, and nevertheless characterized by a simple, yet rugged, construction; said characterizing structural features thereby overcoming the foregoing and other shortcomings of the prior art. Specifically, it is an object to provide a simple, essentially two-piece structure, each piece of which cooperates with the other to surround, and thereby protect the propeller, and also complete a stable, and thus an effective force-resisting structure depending from the bottom of the boat.

Contemplated for use with a boat having a stern propeller powered in rotation by a propeller shaft journalled in a depending shaft strut, a protective structure demonstrating objects and advantages of the present invention includes a three-sectioned debris-blocking member having a U-shaped attaching section connected to the depending shaft strut. An oblique blocking section extends from the U-shaped section and has an operative position located in the vertical plane of the propeller shaft and forwardly of the propeller. From said oblique section there extends a horizontally oriented blocking section, also in the vertical plane of the propeller shaft, and beneath the propeller. More particularly, the juncture of said oblique and said horizontally oriented blocking sections are located substantially in the operating plane of the propeller. Completing the structure is a U-shaped holding member connected at its free ends to extend in depending relation from the boat and in surrounding relation about the propeller, said depending end of the U-shaped holding member being connected to said oblique and horizontally oriented sections at said juncture therebetween, whereby contact of the propeller with any debris is minimized by the protective structure by virtue of its surrounding position about the propeller.

The above brief description, as well as further objects, features and advantages of the present invention, will be more fully appreciated by reference to the following detailed description of presently preferred, but nonetheless illustrative embodiments in accordance with the present invention, when taken in conjunction with the accompanying drawings, wherein:

FIG. 1 is a side elevational view of the protective structure hereof applied about one of the propellers of a twin-engine craft of boat;

FIG. 2, set forth on a separate sheet of drawing, is a perspective, exploded view of the components which comprise a preferred embodiment of the boat propeller protective structure hereof;

Figure 1:
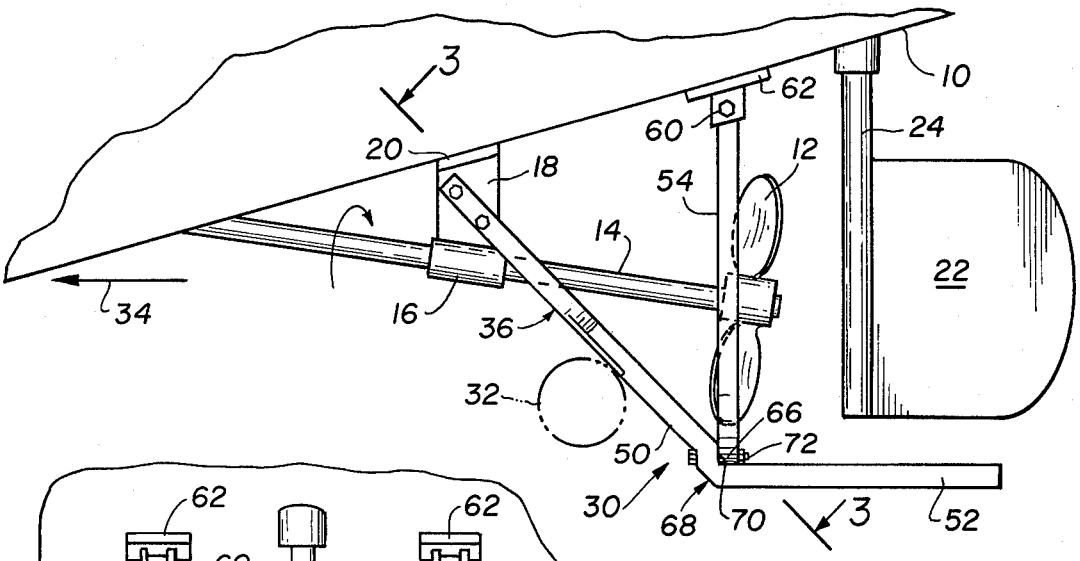
Figure 2:
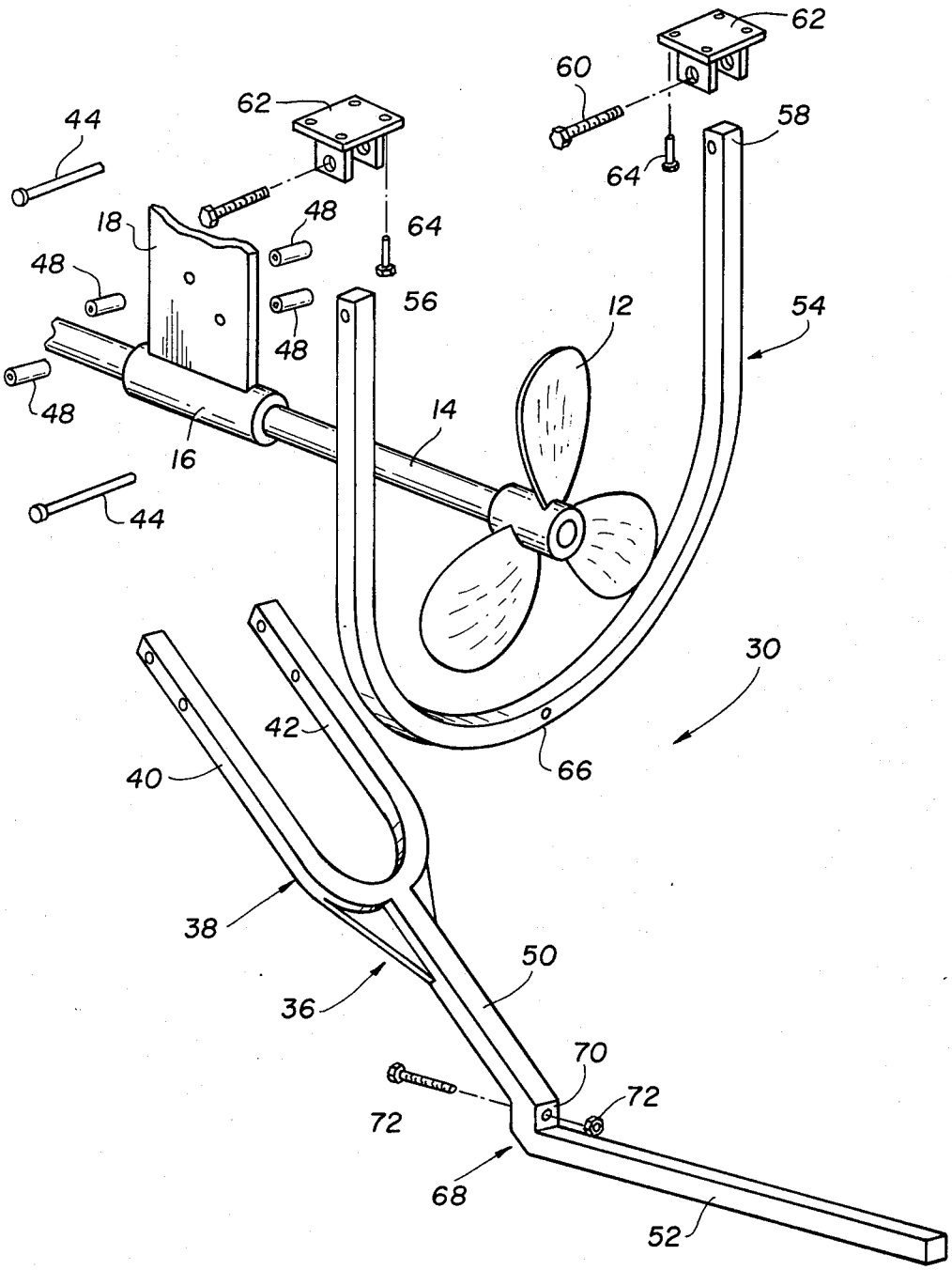

Reference is now made to the drawings, and in particular to FIGS. 1 and 2 which best illustrate the environment for the within inventive protective structure. More particularly, this structure is contemplated being used along the bottom of a craft or boat 10 of the type having a propeller 12 which is powered in rotation by a propeller shaft 14 which is journalled in a sleeve bearing 16. The free end of a depending so-called shaft strut 18 connected, as at 20, to the bottom of the boat 10 supports the bearing 16, and thus the shaft 18. As illustrated in FIG. 1, there is also usually provided a rudder 22 pivotally mounted on a depending shaft 24 rearwardly of the plane of operation of the propeller 12. It is in the environment just described that noteworthy and advantageous use is made of a protective structure, generally designated 30, to protect the propeller 12 from contact, and therefore possible damage, with debris, illustratively designated 32 in FIG. 1, which might be in the path of propeller 12 during movement 34 of boat 10.

Figure 3:
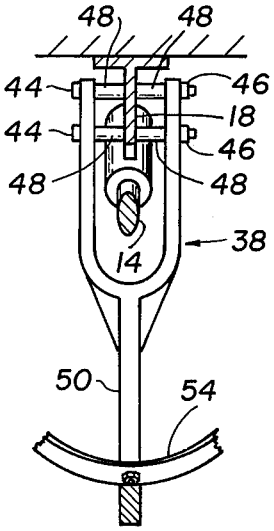
FIG. 3 is a sectional view, taken along lines 3—3 of FIG. 1, showing further structural details.

Protective structure 30, in the preferred embodiment illustrated, includes, as is perhaps best illustrated in FIG. 2, a three-section debris-blocking member, generally designated 36. The first section of member 36, namely that located at one end thereof, consists of a U-shaped attaching section or yoke 38, in turn comprised of bifurcated arms 40 and 42. In practice, arms 40 and 42 are located on opposite sides of the previously noted shaft strut 18. By examination of FIG. 2 in conjunction with FIG. 3, it should be readily appreciated how yoke 38 is connected to extend from the strut 18 using bolts 44 threadably engaged in nuts 46, and spacing sleeves 48 for maintaining the strut 18 centrally of the yoke 38.

As an integral extension of the yoke 38, member 36 further includes an obliquely oriented rod-like length portion or debris-blocking section 50. In its operative position, as illustrated in FIG. 1, the oblique section 50, by virtue of extending centrally of the yoke 38 lies in the vertical plane of the propeller shaft 14 and also, as clearly illustrated, it is positioned forwardly of the propeller 12. Thus, section 50 is in an advantageous position to block the debris object 32 from making contact with the propeller 12.

It is contemplated, however, that the object 32 might conceivably slide under the section 50 and rise up into contact with the propeller 12. Thus, a preferred embodiment of the protective structure 30 also includes, as an extension of the oblique section 50, a further debris-blocking length portion or section 52, the operative position of which is essentially horizontally oriented with respect to the plane of operation of the propeller 12. As clearly illustrated, the horizontally oriented section 52 is located beneath the propeller 12 and also, by virtue of being appropriately sized, extends also beneath the rudder 22. Thus, section 52 protects not only the propeller 12 but also the rudder 22 from inadvertent contact with any debris 32.

Figure 4:
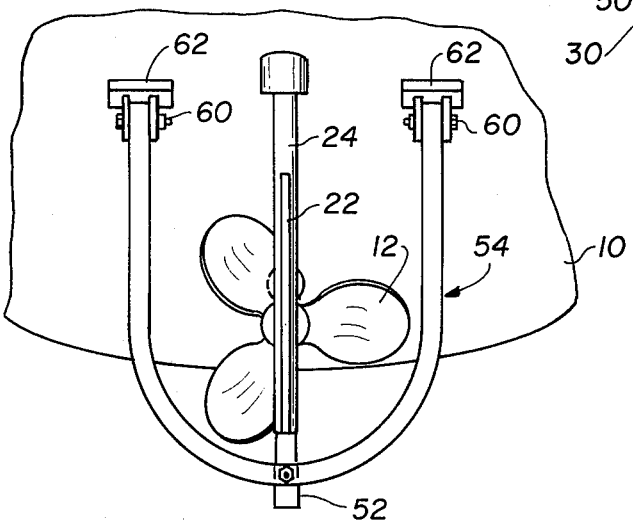
FIG. 4 is a rear elevational view of the structure, as seen from behind FIG. 1, i.e. looking from the stern to the bow of the boat.

To maintain the protecting position of the protective structure 30 use is made of U-shaped holding member 54. The opposite free ends 56 and 58 of this member are pivotally connected by bolts 60 within brackets 62 which, in turn, are connected, as by bolts 64, to the bottom of the boat 10. Thus, the operational position of member 54 is one in which it is suspended generally vertically from the bottom of the boat in the operating plane of the propeller 12, and thus in surrounding relation about the propeller 12. This operational position of member 54 is completed by the connection of its depending end 66 to member 36 at the juncture 68 of the oblique section 50 with the horizontally oriented section 52. Specifically, at juncture 68 a shoulder 70 is provided on member 36 which functions as a seat for the lower end 66 of member 54 which is bolted, as at 72, in position. As a consequence, and as is perhaps best illustrated in FIG. 4, member 54 rigidifies or stabilizes the position of the debris-blocking member 36 and itself also occupies a protective position about and in the plane of operation of the propeller 12.

Figure 5:
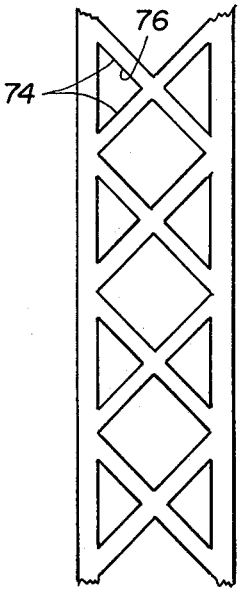
FIGS. 5 and 6 are detailed views, on an enlarged scale, of a preferred form of the material of construction of the structural members used for the protective structure, FIG. 5 being a front elevational view thereof, and FIG. 6 a side elevational view.
Figure 6:
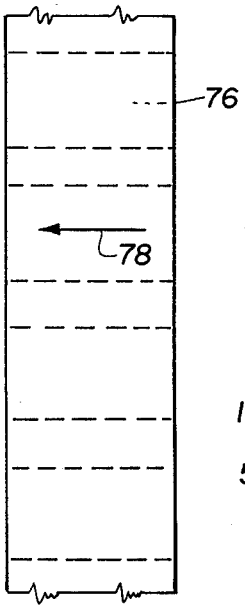

To minimize the drag resistance of the protective structure 30 consisting, as just described, of member 36 and U-shaped member 54, these members are preferably constructed of a high shock resistant plastic, such as polycarbonate which is sold under the trademark LEXAN by General Electric of Pittsfield, Mass. Further, the components are preferably injection molded so as to include, as illustrated in FIGs. 5, 6, walls 74 which bound openings 76 through which there is water flow or passage 78 during movement of the boat. This, in an obvious manner, minimizes the drag resistance of the protective structure 30.

Figure 7:
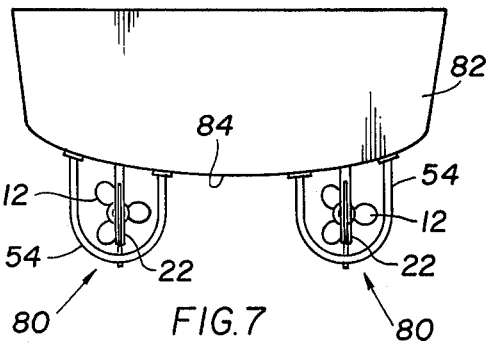
FIG. 7, like FIG. 4, is a rear elevational view, and illustrates the set-up for both propellers.

In FIG. 7, to which reference is now made, there is shown a dual set-up, generally designated 80, consisting of the components and the operative arrangement thereof which has just been described in connection with FIGS. 1–6. The dual set-up 80 of FIG. 7 is of course the total arrangement that in practice is applied to a twin engine craft 82. Said set-up 80 is substantially identical to the protective structure 30 already described. The only difference embodied in set-up 80 is a need to adjust the relative length of the arms of the U-shaped member 54 in order to conform to the bottom curvature 84 of the boat 82. Since, as illustrated in FIG. 7 the set-ups 80 are on opposite sides of the longitudinal center of the boat, the curvature at these positions require unequal lengths in the two arms of the U-shaped member 54.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A protective structure for the propeller of a boat of the type wherein said propeller operates beneath the stern of said boat and is powered in rotation by a propeller shaft journalled in a depending shaft strut, said protective structure comprising a three-sectioned debris-blocking member including a U-shaped attaching section connected to said depending shaft strut, an oblique blocking section extending from said U-shaped section having an operative position located in the vertical plane of said propeller shaft and forwardly of said propeller, and a substantially horizontally oriented blocking section extending from said oblique blocking section having an operative position located also in the vertical plane of said propeller shaft and beneath said propeller, the juncture of said oblique and said horizontally oriented blocking sections being located substantially in the operating plane of said propeller, and a U-shaped holding member connected at its free ends to extend in depending relation from said boat and in surrounding relation about said propeller, said depending end of said U-shaped holding member being connected to said oblique and horizontally oriented sections at said juncture therebetween, whereby contact of said propeller with any debris is minimized by said protective structure by virtue of its surrounding position about said propeller.

2. A boat propeller protective structure as defined in claim 1 wherein said boat includes a rudder located rearwardly of said propeller, and said horizontally oriented blocking section is sized to extend also beneath said rudder so as to contribute to minimizing any contact by debris with said rudder.

3. A boat propeller protective structure as defined in claim 2 wherein said ends of said U-shaped holding member are pivotally connected to said boat, whereby pivotal movement thereof is utilized in establishing the connection of said U-shaped holding member at said juncture between said oblique and said horizontally oriented sections.

4. A boat propeller protective structure as defined in claim 3 including a shoulder forming a seat at said juncture for said U-shaped holding member.

5. A boat propeller protective structure as defined in claim 4 wherein said debris-blocking and said U-shaped holding members are rod-like and preferably constructed of plastic.

6. A boat protective structure as defined in claim 5 wherein said rod-like plastic construction material is further preferably porous, so as to offer an optimum minimum drag resistance during movement of the boat.

* * * * *